US007503598B2

(12) United States Patent
Graute

(10) Patent No.: US 7,503,598 B2
(45) Date of Patent: Mar. 17, 2009

(54) MOTOR VEHICLE DOOR LOCK

(75) Inventor: Ludger Graute, Essen (DE)

(73) Assignee: Kiekert AG, Heiligenhaus (DE)

( * ) Notice: Subject to any disclaimer, the term of this patent is extended or adjusted under 35 U.S.C. 154(b) by 0 days.

(21) Appl. No.: 10/555,378

(22) PCT Filed: Apr. 30, 2004

(86) PCT No.: PCT/DE2004/000918

§ 371 (c)(1),
(2), (4) Date: Nov. 2, 2005

(87) PCT Pub. No.: WO2004/101921

PCT Pub. Date: Nov. 25, 2004

(65) Prior Publication Data

US 2006/0131894 A1 Jun. 22, 2006

(30) Foreign Application Priority Data

May 8, 2003 (DE) ..... 103 20 459

(51) Int. Cl.
*E05C 3/06* (2006.01)

(52) U.S. Cl. ..... 292/216; 292/201; 292/DIG. 23

(58) Field of Classification Search ..... 292/201, 292/216, DIG. 23

See application file for complete search history.

(56) References Cited

U.S. PATENT DOCUMENTS

| | | | | |
|---|---|---|---|---|
| 4,073,519 | A * | 2/1978 | Kurozu et al. | 292/216 |
| 4,358,141 | A * | 11/1982 | Hamada | 292/216 |
| 4,756,564 | A * | 7/1988 | Ikeda | 292/216 |
| 4,854,617 | A | 8/1989 | Hayakawa et al. | |
| 5,020,838 | A * | 6/1991 | Fukumoto | 292/201 |
| 5,348,357 | A * | 9/1994 | Konchan et al. | 292/216 |
| 6,631,930 | B2 * | 10/2003 | Haglund | 292/1 |
| 6,749,234 | B2 * | 6/2004 | Bruce | 292/216 |
| 6,789,825 | B2 * | 9/2004 | Kalargeros et al. | 292/216 |
| 6,811,193 | B2 * | 11/2004 | Arabia et al. | 292/216 |
| 7,188,872 | B2 * | 3/2007 | Kalargeros et al. | 292/216 |
| 7,195,292 | B2 * | 3/2007 | Ketelsen et al. | 292/216 |
| 2006/0279090 | A1 * | 12/2006 | Ottino et al. | 292/216 |

FOREIGN PATENT DOCUMENTS

| | | | |
|---|---|---|---|
| EP | 0 808 978 | A2 | 11/1997 |
| EP | 1 126 108 | A1 | 8/2001 |
| GB | 2 284 231 | A | 5/1995 |
| IT | EP0995870 | A1 * | 4/2000 |

* cited by examiner

*Primary Examiner*—Patricia L Engle
*Assistant Examiner*—Kristina R Fulton
(74) *Attorney, Agent, or Firm*—Matthias Scholl, PC; Matthias Scholl

(57) ABSTRACT

The invention refers to a vehicle door latch with a catch and pawl, in which the catch contains a cushioning stop and said cushioning stop being designed as a spring stop for the reset spring of the catch on its non-cushioning side.

23 Claims, 2 Drawing Sheets

MOTOR VEHICLE DOOR LOCK

CROSS-REFERENCE TO RELATED APPLICATIONS

This is a National Stage Application of International Patent Application No. PCT/DE 2004/000918, with an international filing date of Apr. 30, 2004, which is based on German Patent Application No. 103 20 459.8, filed May 8, 2003. The contents of both of these specifications are incorporated herein by reference.

BACKGROUND OF THE INVENTION

1. Field of the Invention

The invention refers to vehicle door latch with at least one locking mechanism containing a catch, acted upon by a reset spring and a pawl and an inlet opening as well as a locking pin cooperating with the catch (on a respective vehicle door).

2. Description of Related Art

In the reference system of the vehicle door latch, the locking pin moves into the inlet opening. Generally, the locking pin is located on the vehicle body whilst, in contrast, the vehicle door latch and logically the inlet opening are moved.

Such a vehicle door latch is known in which the inlet opening contains a cushioning element, which ensures that the locking pin moving into the inlet opening and then held in its primary position by the catch, is fixed in this position with less noise (see EP 0 336 034 A2).—Irrespective of this, a reset spring acts upon the catch to turn the catch from its closed position back into its open position after disengagement of the pawl assigned to it, when the vehicle door is being opened or is open. For this reset spring, a spring stop is molded on the catch. This is costly from a material and production point of view.—The invention aims to solve this problem.

BRIEF DESCRIPTION OF THE DRAWINGS

Below, the invention is explained in detail with reference to a drawing representing only one embodiment of the invention, in which.

BRIEF SUMMARY OF THE INVENTION

Figure 1:
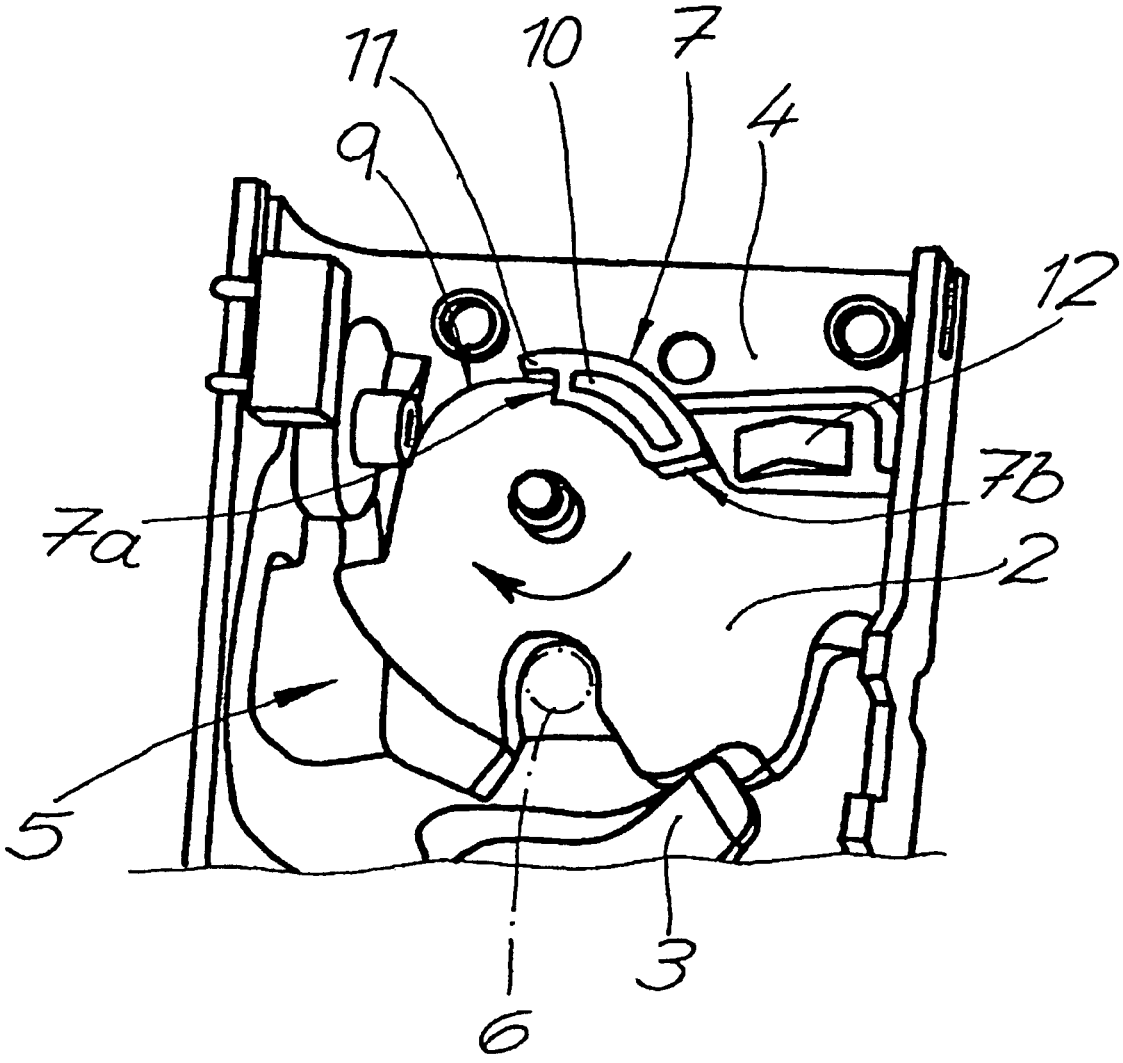
FIG. 1 shows a vehicle door latch of the invention with top view onto a back plate with a locking mechanism, without a reset spring and with a cushioning stop for the catch, and FIG. 2 an enlarged excerpt from the object of FIG. 1 including reset spring and cushioning stop for the catch.

The invention described herein provides a vehicle door latch with at least one locking mechanism (2, 3) containing a catch (2) being acted upon by a reset spring (1) and a pawl (3) and with an inlet opening (5) as well as a locking pin (6), cooperating wit the catch (2), characterized in that the catch (2) contains a cushioning stop (7) and that the cushioning stop (7) is designed as a spring stop (7*a*) for the reset spring (1) on its non-cushioning side.

In certain embodiments of the invention described herein, the catch (2) is encased with soundproofing material, such as thermoplastic plastic such as polyurethane and that the cushioning stop (7) and spring stop (7*a*) are part of the casing (9).

In certain embodiments of the invention described herein, the cushioning stop (7) is designed as a stop rib arranged in the area around the catch.

In certain embodiments of the invention described herein, the stop rib (7) contains a pocket-like recess (10).

In certain embodiments of the invention described herein, the stop rib (7) contains a stop face (7*b*) at one end and a spring connection (11), such as a connection projection, at its other end.

DETAILED DESCRIPTION OF THE INVENTION

The invention has the task of providing a vehicle door latch of the type described above, in which the catch operates quietly and offers a simpler construction.

The invention solves the task in a vehicle door latch of the described type by the catch containing a cushioning stop and this cushioning stop on its non-cushioning side also being designed as a spring stop for the reset spring.—The invention is based on the knowledge that in case of a vehicle door latch, a considerable noise reduction as part of, in particular, the opening process, can be achieved if not only a cushioning element is provided for the locking pin of the assigned vehicle door, but in addition also a cushioning stop for the catch. The cushioning stop for the catch can, at the same time, cooperate with the cushioning element for the locking pin. Such a cushioning stop can, at the same time, also be designed as a spring stop for the reset spring, so that a separate spring stop, molded on the catch, is no longer required. In this way a, from a production and technical point of view, simpler construction is achieved, saving on material and mass. According to a preferred embodiment of the invention, the catch is encased in a soundproofing material, such as plastic or polyurethane or similar, with the cushioning and spring stop forming a part of this casing. Such a plastic casing with cushioning and spring stop is relatively easy to produce and relatively light, so that in this way the above mass reduction can be achieved, which is of considerable importance for moving parts.

Other measures of the invention are listed below. According to the invention, the cushioning stop is, for instance, designed as a stop rib arranged around the edge of the catch, following the perimeter of the catch over a specified partial section. For this purpose, the stop rib contains a pocket-like recess and consequently also operates like a buffer, so that an increased cushioning effect is achieved. The stop rib also contains an uncovered stop face at one end and a spring connection for the reset spring at the other end, such as a connection projection for the legs of a reset spring, designed as a leg spring.

The figures show a vehicle door latch with at least one locking mechanism, containing a catch 2 acted upon by a reset spring 1 and a pawl 3 cooperating with catch 2 in a back plate 4, and a locking pin 6 moving into an inlet opening 5 and cooperating with the catch 2 in a respective vehicle door that is only indicated. The reset spring 1 acts upon the catch 2 in the opening sense and consequently in clockwise direction, indicated by an arrow. The pawl 3 can be activated mechanically, by a lever mechanism—not shown—or also by means of a motor, in particular an electric motor.

Figure 2:
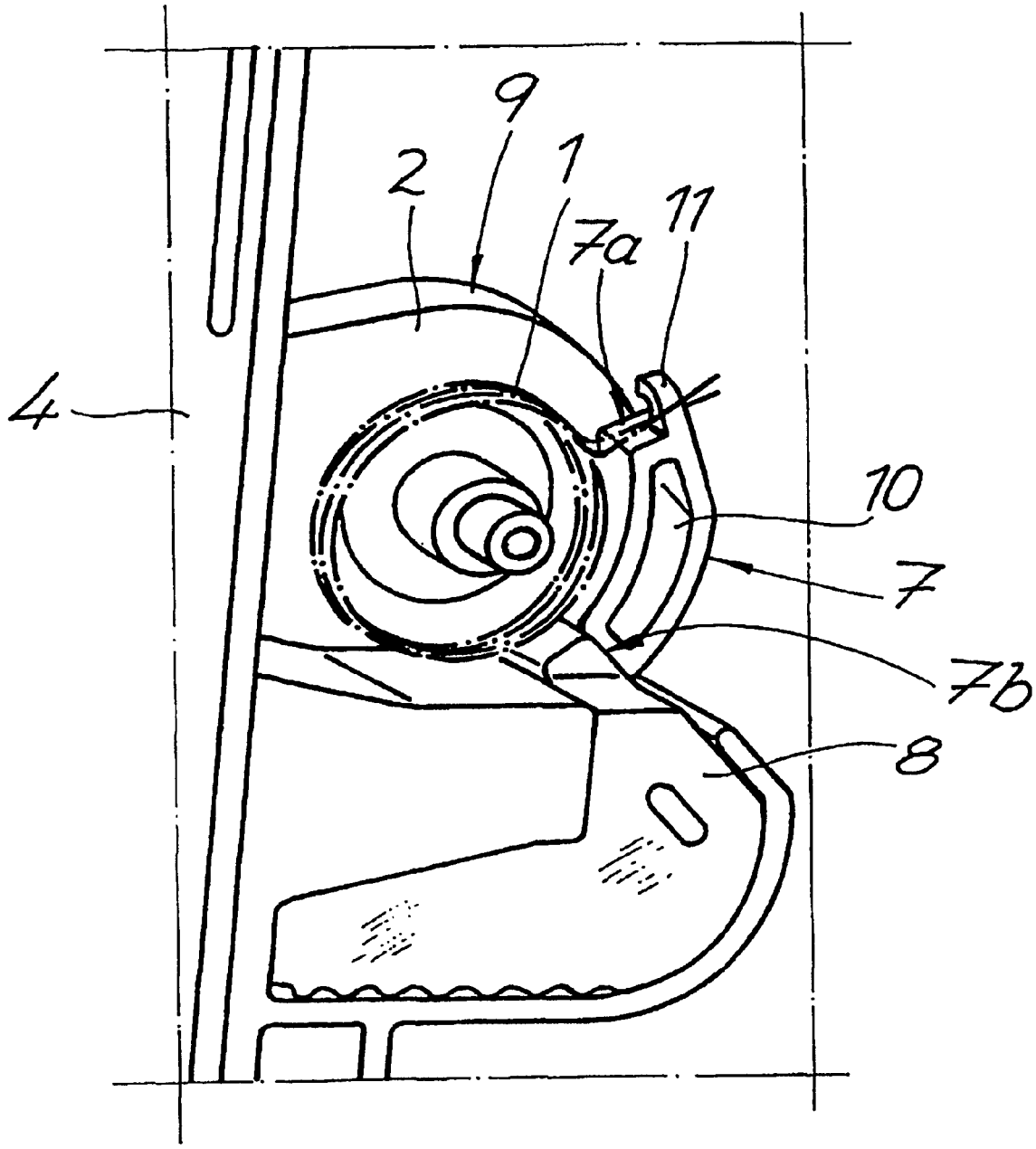

The catch 2 contains a cushioning stop 7, moving in the opened position (clockwise in FIG. 2) against a buffer-like cushioning element 8. This cushioning element 8 is located in the back plate 4. The cushioning stop 7 on the catch 2 is designed as a spring stop 7*a* for the reset spring 1 on its non-cushioning side. The catch 2 and, where applicable, also the pawl 3, to some extent, are encased with a soundproofing material such as plastic or polyurethane, with the cushioning stop 7 and the spring stop 7*a* being part of the casing 9. The cushioning stop 7 is designed as a stop rib, arranged around the edge of the catch and following the periphery of the catch 2 over a partial section. This stop rib 7 contains a pocket-like recess 10 and is therefore also characterized by its own buffering effect. The stop rib 7 contains a simple stop face 7*b* at its cushioning end and a spring connection 11, such as a connection projection for the reset spring 1, designed for instance as a leg spring, at its other end. All in all, a locking mechanism low in friction and noise is provided, which is characterized by its simple and its well functioning construction.

FIG. 1 also shows a stop 12 in the back plate or latch housing, which limits or restricts an overtravel of catch 2. The cushioning stop 7 serves, on the other hand, for stopping or limiting the opening movement of the catch 2. The cushioning stop 7 can also be equipped with one or several reinforcement ribs.

What is claimed is:

1. A vehicle door latch with at least one locking mechanism (2, 3) comprising:

a latch housing (4), having an inlet opening (5) for receiving a locking pin (6);

a cushioning element (8);

a catch (2) having a casing (9) and a periphery;

a cushioning stop (7);

a reset spring (1) for resetting said catch (2); and a pawl (3);

wherein said cushioning element (8) is disposed on the latch housing (4);

said cushioning stop (7) is a stop rib disposed around a partial section of said periphery of the catch (2);

said cushioning stop (7) has a cushioning side (7*b*) and a non-cushioning side (7*a*);

said cushioning stop (7) limits an opening movement of said catch (2) by engaging in the opened position against said cushioning element (8);

said non-cushioning side (7*a*) forming a spring connection (11) for said reset spring (1); and one end of said reset spring (1) is directly connected to said spring connection (11) at the periphery of said catch.

2. The vehicle door latch of claim 1, wherein said cushioning stop (7) is encased with a soundproofing material.

3. The vehicle door latch of claim 1, wherein said pawl (3) is encased with a soundproofing material.

4. The vehicle door latch of claim 2, wherein said soundproofing material is made of plastic.

5. The vehicle door latch of claim 3, wherein said soundproofing material is made of plastic.

6. The vehicle door latch of claim 4, wherein said soundproofing material is made of polyurethane.

7. The vehicle door latch of claim 5, wherein said soundproofing material is made of polyurethane.

8. The vehicle door latch of claim 2, wherein said casing (9) comprises said cushioning stop (7).

9. The vehicle door latch of claim 2, wherein said cushioning stop (7) comprises further a pocket-like recess (10).

10. The vehicle door latch of claim 2, wherein said cushioning stop (7) is movable against said cushioning element (8).

11. The vehicle door latch of claim 2 comprising further a second stop (12), said second stop (12) being disposed on the latch housing (4), and said second stop (12) limiting an overtravel of said catch (2).

12. The vehicle door latch of claim 2, wherein said cushioning stop is reinforced.

13. A vehicle door latch with at least one locking mechanism (2, 3) comprising:

a latch housing (4), having an inlet opening (5) for receiving a locking pin (6);

a cushioning element (8);

a catch (2) having a casing (9) made of a soundproofing material and a periphery;

a cushioning stop (7);

a reset spring (1) for said catch (2); and a pawl (3);

wherein said cushioning element (8) is disposed on the latch housing (4);

said cushioning stop (7) is disposed around a partial section of said periphery of the catch (2), said cushioning stop (7) has a cushioning side (7*b*) and a non-cushioning side (7*a*), said cushioning stop (7) limits an opening movement of said catch (2) by engaging in the opened position with said cushioning side (7*b*) against said cushioning element (8); and said non-cushioning side (7*a*)forming a spring connection (11) for said reset spring (1);

one end of said reset spring (1) is directly connected to said spring connection (11) at the periphery of said catch; and another end of said reset spring (1) is wound around an axis of rotation of said catch (2).

14. The vehicle door latch of claim 13, wherein said soundproofing material is made of plastic.

15. The vehicle door latch of claim 14, wherein said soundproofing material is made of polyurethane.

16. The vehicle door latch of claim 13, wherein said cushioning stop (7) comprises further a pocket-like recess (10).

17. The vehicle door latch of claim 13, wherein said cushioning stop (7) is movable against said cushioning element (8).

18. The vehicle door latch of claim 13 comprising further a second stop (12), said second stop (12) being disposed on the latch housing (4), and said second stop (12) limiting an overtravel of said catch (2).

19. The vehicle door latch of claim 13, wherein said cushioning stop (7) is reinforced.

20. A vehicle door latch with at least one locking mechanism (2, 3) comprising:

a latch housing (4), having an inlet opening (5) for receiving a locking pin (6);

a cushioning element (8);

a catch (2) having a casing (9) and a periphery;

a cushioning stop (7);

a reset spring (1) for resetting said catch (2); and a pawl (3);

wherein said cushioning element (8) is disposed on the latch housing (4);

said cushioning stop (7) is a stop rib disposed around a partial section of said periphery of the catch (2) and does not include a portion of said catch;

said cushioning stop (7) has a cushioning side (7*b*) and a non-cushioning side (7*a*);

said cushioning stop (7) limits an opening movement of said catch (2) by engaging in the opened position of said catch with the entire said cushioning side (7*b*) against said cushioning element (8);

said non-cushioning side (7*a*) forming a spring connection (11) for said reset spring (1); and one end of said reset spring (1) is directly connected to said spring connection (11) at the periphery of said catch.

21. The vehicle door latch of claim 20, wherein said non-cushioning side (7*a*) does not engage against said cushioning element (8); and said catch (2) is not connected to said pawl (3) by said reset spring (1).

22. The vehicle door latch of claim 21, wherein said cushioning element (8) and said cushioning stop (7) are made essentially entirely of a soundproofing material.

23. The vehicle door latch of claim 21, wherein said stop rib protrudes from said catch (2) and is raised with respect to the plane of said catch (2).

* * * * *